US010513006B2

(12) United States Patent
Wu et al.

(10) Patent No.: US 10,513,006 B2
(45) Date of Patent: Dec. 24, 2019

(54) HIGH THROUGHPUT CMP PLATFORM

(71) Applicant: Taiwan Semiconductor Manufacturing Co., Ltd., Hsin-Chu (TW)

(72) Inventors: Jiann Lih Wu, Hsin-Chu (TW); Jason Shen, Jhubei (TW); Soon-Kang Huang, Hsin Chu (TW); James Jeng-Jyi Hwang, Chu-Tong Town (TW); Chi-Ming Yang, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 341 days.

(21) Appl. No.: 13/758,378

(22) Filed: Feb. 4, 2013

(65) Prior Publication Data

US 2014/0220863 A1 Aug. 7, 2014

(51) Int. Cl.
*B24B 37/005* (2012.01)

(52) U.S. Cl.
CPC ..... *B24B 37/005* (2013.01)

(58) Field of Classification Search
USPC ..... 451/11, 5
See application file for complete search history.

(56) References Cited

U.S. PATENT DOCUMENTS 5,738,574 A * 4/1998 Toiles et al. ..... 451/288
6,435,942 B1 8/2002 Jin et al.
6,585,567 B1 * 7/2003 Black ..... B24B 37/0056 257/E21.214
6,690,473 B1 * 2/2004 Stanke ..... B24B 37/34 257/E21.53
7,195,535 B1 * 3/2007 Swedek et al. ..... 451/5
8,308,529 B2 * 11/2012 D'Ambra ..... B24B 27/0076 451/287

(Continued)

FOREIGN PATENT DOCUMENTS

CN 101990703 A 3/2011

OTHER PUBLICATIONS

Fabtech description of Reflexion GTTM CMP system; Jun. 2011; found at http://www.fabtech.org/product_briefings/_a/applied_materials_reflexion_gttm_cmp_system_tackles_tungsten_films_at_lowes/ attached as pdf.*

*Primary Examiner* — Brian D Keller
(74) *Attorney, Agent, or Firm* — Eschweiler & Potashnik, LLC

(57) ABSTRACT

A chemical-mechanical polishing system has a first polishing apparatus configured to perform a first chemical-mechanical polish on a workpiece and a second polishing apparatus configured to perform a second chemical-mechanical polish on the workpiece. A rework polishing apparatus comprising a rework platen and a rework CMP head is configured to perform an auxiliary chemical-mechanical polish on the workpiece when the workpiece is positioned on the rework platen. A measurement apparatus measures one or more parameters of the workpiece, and a transport apparatus transports the workpiece between the first polishing apparatus, second polishing apparatus, rework polishing apparatus, and measurement apparatus. A controller determines a selective transport of the workpiece to the rework polishing apparatus by the transport apparatus only when the one or more parameters are unsatisfactory.

20 Claims, 5 Drawing Sheets

(56) References Cited

U.S. PATENT DOCUMENTS

| | | | | |
|---|---|---|---|---|
| 2002/0182760 | A1* | 12/2002 | Wack | G01N 21/211 438/14 |
| 2002/0182978 | A1* | 12/2002 | Lukner | B24B 37/042 451/5 |
| 2003/0045100 | A1* | 3/2003 | Saka | B24B 37/013 438/689 |
| 2004/0009738 | A1* | 1/2004 | Doi | B24B 37/046 451/36 |
| 2004/0058620 | A1* | 3/2004 | Gotkis | B24B 37/042 451/5 |
| 2004/0063318 | A1* | 4/2004 | Nagel et al. | 438/689 |
| 2004/0078108 | A1* | 4/2004 | Choo | G01N 21/4738 700/121 |
| 2005/0023491 | A1* | 2/2005 | Young et al. | 250/559.42 |
| 2005/0026543 | A1 | 2/2005 | Han | |
| 2006/0258023 | A1* | 11/2006 | Rolofson et al. | 438/14 |
| 2008/0081540 | A1* | 4/2008 | Sato | B24B 37/345 451/28 |
| 2008/0138917 | A1* | 6/2008 | Verhaverbeke et al. | 438/16 |
| 2009/0067959 | A1 | 3/2009 | Takahashi et al. | |
| 2009/0270015 | A1* | 10/2009 | D'Ambra | B24B 27/0076 451/28 |
| 2011/0301847 | A1* | 12/2011 | David et al. | 702/1 |

* cited by examiner

HIGH THROUGHPUT CMP PLATFORM

BACKGROUND

In semiconductor manufacturing, semiconductor wafers often undergo many processing steps or stages before a completed die is formed. For example, such processing steps may include lithography, etching, semiconductor doping, and deposition and/or removal of various materials on the semiconductor wafer.

Time taken during different processing steps directly determines the throughput of the individual processes and final throughput of forming the completed die. Some processes, however, may require re-work on a workpiece, wherein corrections are made on the workpiece to attain various standards. For example, during chemical-mechanical polishing (CMP), one or more polishing steps may be performed at one or more respective polishing stations. Once the workpiece has passed through all of the polishing steps, various parameters are measured on the polished workpiece.

Conventionally, when one or more of the measured parameters are not within specifications after CMP processing, the workpiece is typically sent back into the same one or more polishing stations in order to achieve the desired parameters during what is called "re-work". Such re-work techniques, however, typically decrease workpiece throughput through the CMP process, since the same polishing station is redundantly utilized for both the initial polish and the re-work polish. As workpiece sizes increase, such conventional re-work techniques using the same polishing stations decreases throughput due to the longer time taken to polish larger workpieces.

SUMMARY OF THE INVENTION

The following presents a simplified summary in order to provide a basic understanding of one or more aspects of the invention. This summary is not an extensive overview of the disclosure, and is neither intended to identify key or critical elements of the invention, nor to delineate the scope thereof. Rather, the primary purpose of the summary is to present some concepts of the disclosure in a simplified form as a prelude to the more detailed description that is presented later.

In one embodiment, the present disclosure relates to a chemical-mechanical polishing system for increasing throughput, especially when processing workpieces having diameters approaching and/or exceeding 450 mm. The chemical-mechanical polishing system of the present disclosure comprises a first polishing apparatus having a first platen and a first CMP head, a second polishing apparatus having a second platen and a second CMP head, and a rework polishing apparatus having a rework platen and a rework CMP head.

The first CMP head, for example, is configured to perform a rough chemical-mechanical polish on a workpiece when the workpiece is positioned on the first platen. The second CMP head is configured to perform a fine chemical-mechanical polish on the workpiece when the workpiece is positioned on the second platen. Further, the rework CMP head is configured to perform an auxiliary chemical-mechanical polish on the workpiece when the workpiece is positioned on the rework platen.

A measurement apparatus is further provided and configured to measure one or more parameters of the workpiece. A transport apparatus is configured to transport the workpiece between two or more of the first polishing apparatus, second polishing apparatus, rework polishing apparatus, and the measurement apparatus. A loading apparatus may be further provided, wherein the loading apparatus is configured to transport the workpiece between one of a plurality of FOUPs and the transport apparatus. Further, a cleaning apparatus is configured to clean polishing residue from the workpiece. As such, the transport apparatus is further configured to transport the workpiece between the cleaning apparatus and one or more of the first polishing apparatus, second polishing apparatus, and rework polishing apparatus.

A controller is further configured to selectively transport the workpiece to the rework polishing apparatus via the transport apparatus only when the one or more parameters measured by the measurement apparatus are unsatisfactory. As such, additional workpieces may continue to be polished by the first polishing apparatus, second polishing apparatus without affecting throughput.

According to one example, the first polishing apparatus and second polishing apparatus generally define a polishing station, wherein the chemical-mechanical polishing system comprises a plurality of polishing stations configured to process a plurality of workpieces concurrently. In another example, each of the first platen and second platen are configured to concurrently support a plurality of workpieces, wherein the first polishing apparatus and second polishing apparatus are each configured to concurrently chemical-mechanical polish the respective plurality of workpieces.

The transport apparatus, for example, may further comprises a robot configured to selectively transport two or more workpieces via a dual-arm handling apparatus. The robot, for example, is further operably coupled to a track, wherein the robot is configured to translate along the track between two or more of the first, second, and rework polishing apparatuses, the measurement apparatus, a cleaning apparatus, and a load lock chamber.

DETAILED DESCRIPTION

Figure 1B:
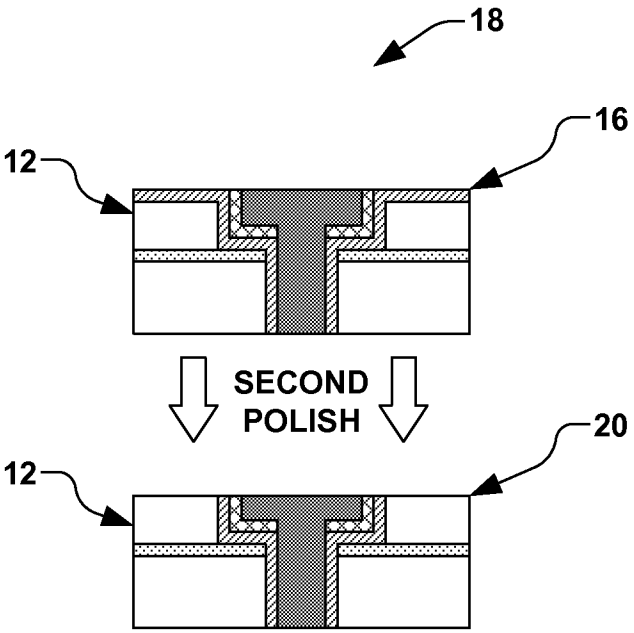
FIGS. 1A-1B illustrates a cross-sectional view of a workpiece undergoing various stages of chemical-mechanical polishing according to one exemplary aspect of the disclosure.

The present disclosure provides a system, apparatus, and method for re-working a workpiece in a chemical-mechanical polish without deleteriously affecting workpiece throughput. Accordingly, the description is made with reference to the drawings, in which like reference numerals are generally utilized to refer to like elements throughout, and wherein the various structures are not necessarily drawn to scale. In the following description, for purposes of explanation, numerous specific details are set forth in order to facilitate understanding. It may be evident, however, to one skilled in the art, that one or more aspects described herein may be practiced with a lesser degree of these specific details. In other instances, known structures and devices are shown in block diagram form to facilitate understanding.

Figure 1A:
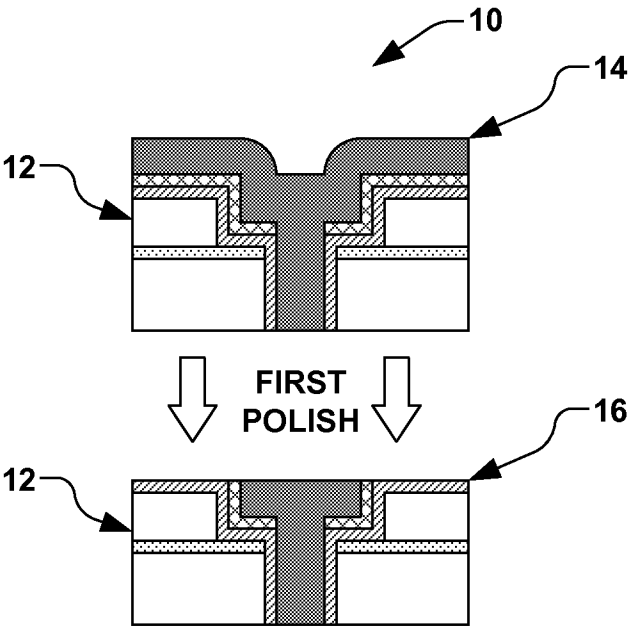

In chemical-mechanical polishing (CMP) processing of workpieces, it is common practice to provide multiple polishing steps, wherein each polishing step removes successive layers on the workpiece. Chemical and/or physical polishing components may differ between polishing steps in order to remove particular layers and/or features previously formed on the workpiece. FIG. 1A, for example, illustrates a first polish step 10, wherein a workpiece 12 is polished from a pre-polish state 14 (e.g., a workpiece having layers formed thereon but not yet having undergone polishing) to an intermediate polish state 16. Once the first polish is complete, the workpiece 12 may be cleaned and transferred to a second polishing step 18, as illustrated in FIG. 1B for removal of subsequent layers in order to form a post-polish state 20. After polishing is complete (e.g., the workpiece 12 is in the post-polish state 20), one or more parameters of the workpiece 12 may be measured in order to determine whether the first and second polish steps were successful.

Conventionally, if the one or more parameters indicated an unsuccessful polish, the workpiece 12 would be sent back to the first polish or second polish, and throughput of workpieces through the CMP process would be deleteriously affected. Further, with workpiece diameters increasing upwards of 450 mm, throughput is negatively affected to a greater degree due to the increased amount of time typically required to re-polish the larger workpieces.

Figure 2:
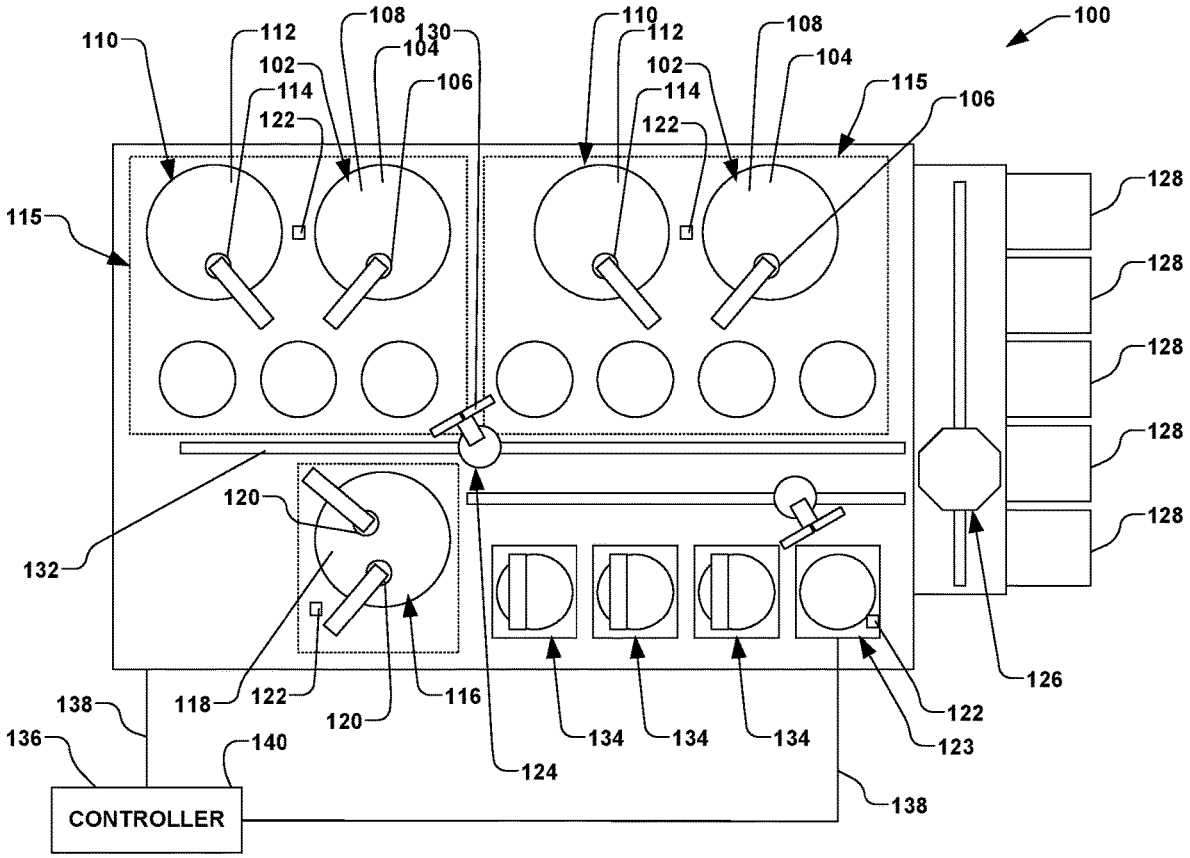
FIG. 2 illustrates a plan view of an exemplary chemical-mechanical polishing system according to another aspect of the disclosure.
Figure 3:
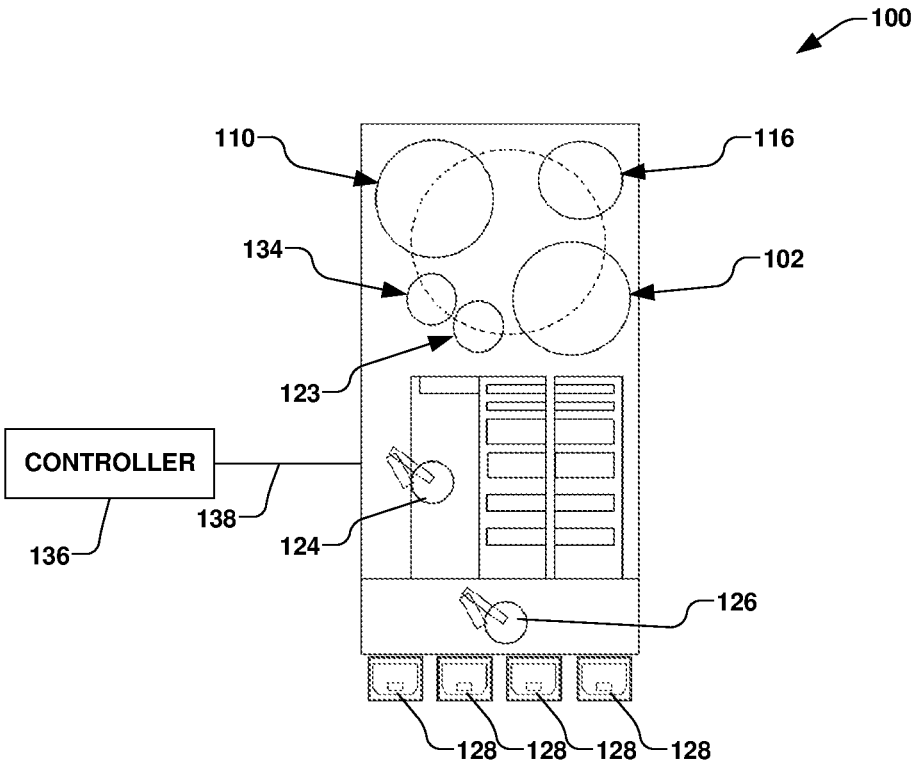
FIG. 3 illustrates a plan view of another exemplary chemical-mechanical polishing system according to another aspect of the disclosure.

Thus, in accordance with one aspect of the disclosure, FIG. 2 illustrates a system 100 for chemical-mechanical polishing of workpieces according to some embodiments. The system 100, for example, comprises a first polishing apparatus 102 comprising a first platen 104 and a first CMP head 106. The first CMP head 106, for example, is configured to perform a first chemical-mechanical polish on a workpiece 108 (e.g., a semiconductor wafer) when the workpiece is positioned on the first platen 104. A second polishing apparatus 110, for example, is further provided, wherein the second polishing apparatus comprises a second platen 112 and a second CMP head 114. The second CMP head 114 is configured to perform a second chemical-mechanical polish on the workpiece 108 when the workpiece is positioned on the second platen 112.

Depending on the thickness and type of material to be removed from the workpiece 108, the first polishing apparatus 102 and the second polishing apparatus differ by type and chemistry of a polishing slurry used, roughness of the respective first CMP head 106 and second CMP head 114, and process recipe such as spin rate, force applied to the workpiece, and duration of the polish. In some embodiments, the first chemical-mechanical polish may be a rough polish and the second chemical-mechanical polish may be a fine polish. In some embodiments, the first chemical-mechanical polish may be configured to remove dielectric material from the workpiece 108 and the second chemical-mechanical polish may be configured to remove metal.

In some examples, the first polishing apparatus 102 and second polishing apparatus 110 generally define a polishing station 115. A number of polishing stations 115 may be provided, each polishing station including a first polishing apparatus 102 and second polishing apparatus 110. Any number of polishing stations 115 are possible. Each polishing station 115 is configured to provide a first polish and a second polish to a number of workpieces 108. For example, each of the first platen 104 and second platen 112 of the respective first polishing apparatus 102 and second polishing apparatus 110 are configured to concurrently support a number of workpieces 108. The first polishing apparatus 102 and second polishing apparatus 110, for example, are thus each configured to concurrently chemical-mechanical polish the respective workpieces 108.

In accordance with the present disclosure, a rework polishing apparatus 116 is further provided that includes a rework platen 118 and a rework CMP head 120. The rework CMP head 120, for example, is configured to perform an auxiliary chemical-mechanical polish on the workpiece 108 when the workpiece is positioned on the rework platen 118. The rework CMP head 120, for example, may be configured to perform a first chemical-mechanical polish (e.g., such as performed by the first CMP head 106), a second chemical-mechanical polish (e.g., such as performed by the second CMP head 114), or both a first chemical-mechanical polish and second chemical-mechanical polish.

In accordance with another example, a measurement apparatus 122 is further provided and configured to measure one or more parameters of the workpiece 108, such as thickness, polish uniformity, or other parameters associated with a surface of the workpiece. For example, the measurement apparatus 122 is configured to detect a thickness, evenness, and/or roughness of the surface of the workpiece 108 before, during, or after polishing. For example, polishing pad wear, lack of uniformity on the surface of the workpiece 108, and an interface of various materials associated with the chemical-mechanical polish may be monitored by the measurement apparatus 122. The measurement apparatus 122 may be configured to provide optical, electrical, thermal, pressure, and/or acoustical sensing. The measurement apparatus 122 may be associated with the first CMP head 106, second CMP head 114, and/or rework CMP head 120. The measurement apparatus 122, for example, may be configured to detect vibrations, motor feedback, or temperature before, during, and/or after chemical-mechanical polishing. Alternatively or in combination, the measurement apparatus 122 may be associated with a measurement station 123, where the one or more parameters of the workpiece 108 may be measured separately from the first polishing apparatus 102, second polishing apparatus 110, and rework polishing apparatus 116.

According to certain examples of the present disclosure, a transport apparatus 124 is provided and configured to transport the workpiece 108 between two or more of the first polishing apparatus 102, second polishing apparatus 110, rework polishing apparatus 116, and the measurement apparatus 122. In accordance with some examples, a loading apparatus 126 is provided. The loading apparatus 126, for example, is configured to transport the workpiece 108 between one of a plurality of FOUPs 128 and the transport apparatus 124. The transport apparatus 124, for example, includes a robot 125 configured to selectively transport two or more workpieces 108 via a dual-arm handling apparatus 130. The robot 125, for example, is further operably coupled to a track 132, wherein the robot is configured to translate along the track between two or more of the first polishing apparatus 102, second polishing apparatus 110, rework polishing apparatus 116, measurement apparatus 122, a cleaning apparatus 134, and loading apparatus 126. The cleaning apparatus 134, for example, is configured to clean or remove polishing residue from the workpiece 108 after chemical-mechanical polishing.

According to various aspects, a controller 136 is further provided and configured to selectively transport the workpiece 108 to the rework polishing apparatus 116 by the transport apparatus 130, such as when the one or more parameters measured by the measurement apparatus 122 are unsatisfactory. For example, after a workpiece 108 undergoes the first chemical-mechanical polish by the first polishing apparatus 102 and/or the second chemical-mechanical polishing by the second polishing apparatus 110, the controller 136 is configured to receive a signal 138 from the measurement apparatus 122. The controller 136 may utilize signal processing techniques to determine polishing status, such as surface uniformity or thickness, based on the signal 138. If, for example, the signal 138 indicates that the result of one or more of the first or second chemical-mechanical polish of the workpiece 108 is unsatisfactory, the controller 136 is configured to direct the transport apparatus 130 to transport the workpiece to the rework polishing apparatus 116. Concurrently, in the present example, the controller 136 directs another workpiece 108 to be transported to the respective first polishing apparatus 102 or second polishing apparatus 110 from the respective FOUP 128 or first polishing apparatus.

In accordance with other aspects, the rework polishing apparatus 116 comprises a variety of rework CMP heads 120. For example, the variety of rework CMP heads 120 are configured to perform various functions and/or follow various chemical-mechanical polishing recipes, such as a rework of the first chemical-mechanical polish (e.g., a "rough" rework polish) and a rework of the second chemical-mechanical polish (e.g., a "fine" rework polish). Various other functions and/or recipes are contemplated as being associated with the rework polishing apparatus 116, such as an auxiliary polish based on a particular removal of metal or other layer, an auxiliary polish of specific locations on the workpiece 108 based on the signal 138 from the measurement apparatus 122, and a particular slurry recipe for removal of various materials, among other functions and/or recipes.

The controller 136, for example, is configured to select one of the variety of rework CMP heads 120 for the auxiliary chemical-mechanical polish based, at least in part, on the signal 138 from the measurement apparatus 122. For example, the measurement apparatus 122 may provide the signal 138 indicating a uniformity of the second chemical-mechanical polish is unsatisfactory, wherein one of the variety of rework CMP heads 120 that is dedicated to uniformity issues is selected by the controller 136 for the auxiliary chemical-mechanical polish. In another example, the measurement apparatus 122 may provide the signal 138 indicating a thickness associated with the first chemical-mechanical polish is unsatisfactory, wherein another one of the variety of rework CMP heads 120 that is dedicated to thickness issues is selected by the controller 136 for the auxiliary chemical-mechanical polish. As such, the controller 136 includes logic to appropriately select one of the variety of rework CMP heads 120 for the auxiliary chemical-mechanical polish at the rework polishing apparatus 116 based on the signal 138 from the measurement apparatus 122.

Further, the controller 136 is configured to direct the robot 125 to selectively transport one workpieces 108 to or from the rework polishing apparatus 116 while concurrently transporting another workpiece to or from one of the first polishing apparatus 102 and second polishing apparatus 110 via the dual-arm handling apparatus 130. The controller 136, in various examples, is further configured to transfer the workpiece to the one of the variety of rework CMP heads 120 for the auxiliary chemical-mechanical polish at the rework polishing apparatus 116 based on the signal 138 from the measurement apparatus 122.

After undergoing the auxiliary chemical-mechanical polish at the rework polishing apparatus 116, the controller 136 can direct the workpiece 108 to be transported back to the FOUP 128. Accordingly, workpieces 108 requiring rework can undergo auxiliary chemical-mechanical polishing by the rework polishing apparatus 116 without significantly interfering with normal throughput of workpieces through the system 100.

Figure 4:
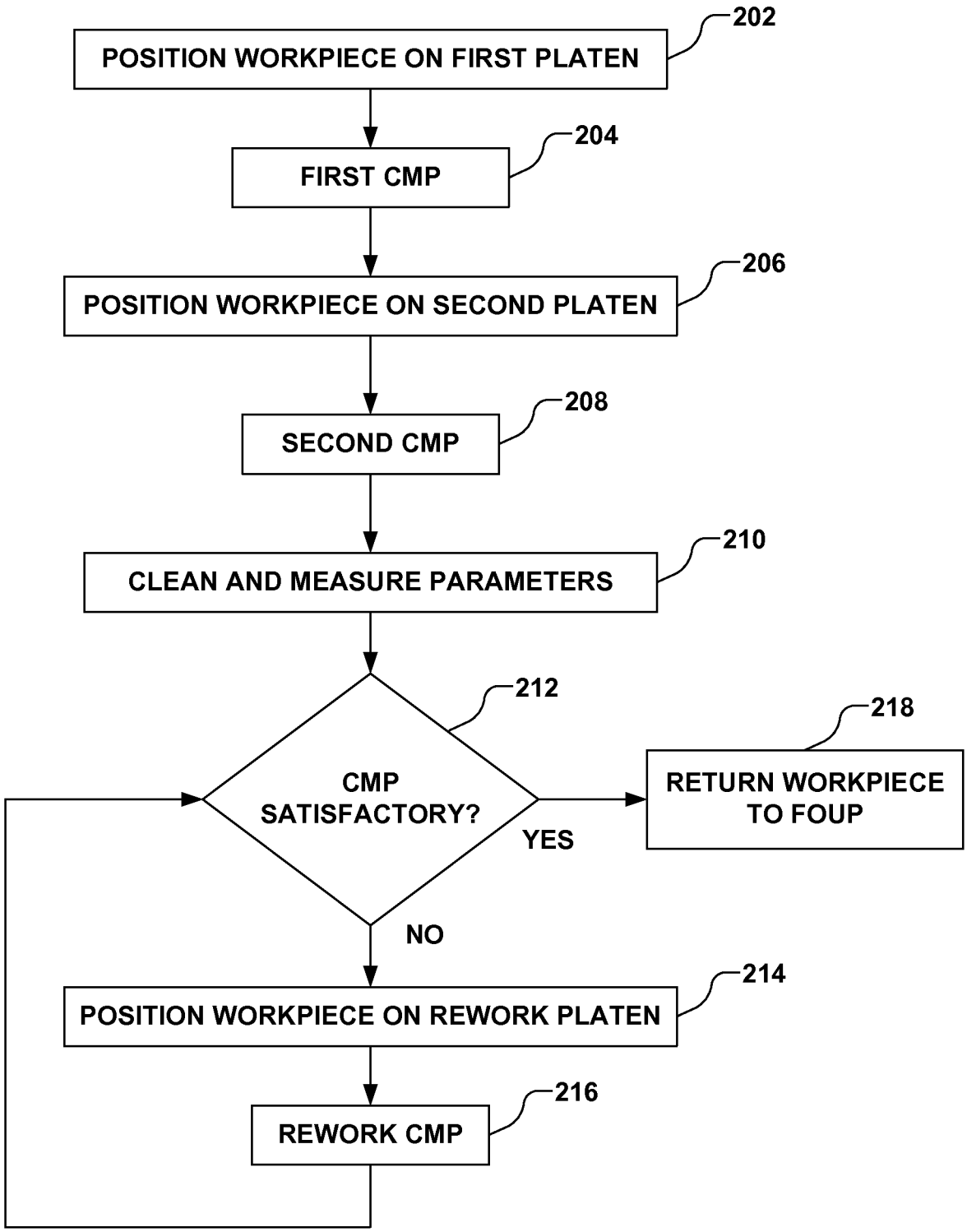
FIG. 4 illustrates a methodology for chemical-mechanical polishing of a workpiece in accordance with another aspect.

According to another aspect of the present disclosure, a method 200 for chemical-mechanical polishing a plurality of workpieces is illustrated in FIG. 4. The method 200, for example, includes positioning a workpiece on a first platen in act 202. For example, the workpiece is removed from a FOUP via a loading apparatus and placed on the first platen via a transfer apparatus. Accordingly, the workpiece positioned on the first platen is polished to a first polish by a first CMP head in act 204. The workpiece is then positioned on a second platen in act 206, such as by removing the workpiece from the first platen and placing the workpiece on the second platen by the transfer apparatus. The workpiece is then polished to a second polish by a second CMP head in act 208. The workpiece is cleaned and one or more parameters associated with a surface of the workpiece are measured in act 210, and in act 212, a determination is made as to whether the one or more parameters are satisfactory. If determination made in act 212 is such that the one or more parameters are unsatisfactory, the workpiece is positioned on a rework platen in act 214, and the workpiece is further polished on the rework platen by a rework CMP head in act 216.

For example, the workpiece is positioned on the rework platen in act 214 when a uniformity associated with the second chemical-mechanical polish is determined to be unsatisfactory in act 212, wherein one of a variety of rework CMP heads that is dedicated to uniformity issues is selected to perform an auxiliary chemical-mechanical polish. In another example, the workpiece is positioned on the rework platen in act 214 when a thickness or other parameter associated with the first chemical-mechanical polish is determined to be unsatisfactory in act 212, wherein one of the variety of rework CMP heads 120 associated with thickness or the other parameter is selected to perform an auxiliary chemical-mechanical polish. As such, the method 200 provides logic to appropriately select one of the variety of rework CMP heads for the auxiliary chemical-mechanical polish based on the one or more measured parameters.

Accordingly, a throughput of additional workpieces to the first and second platens is not impacted by the further auxiliary polish of the workpiece on the rework platen. If the determination made in act 212 is such that the one or more parameters are satisfactory, the workpeice is returned to the FOUP by the loading apparatus in act 218.

Figure 5:
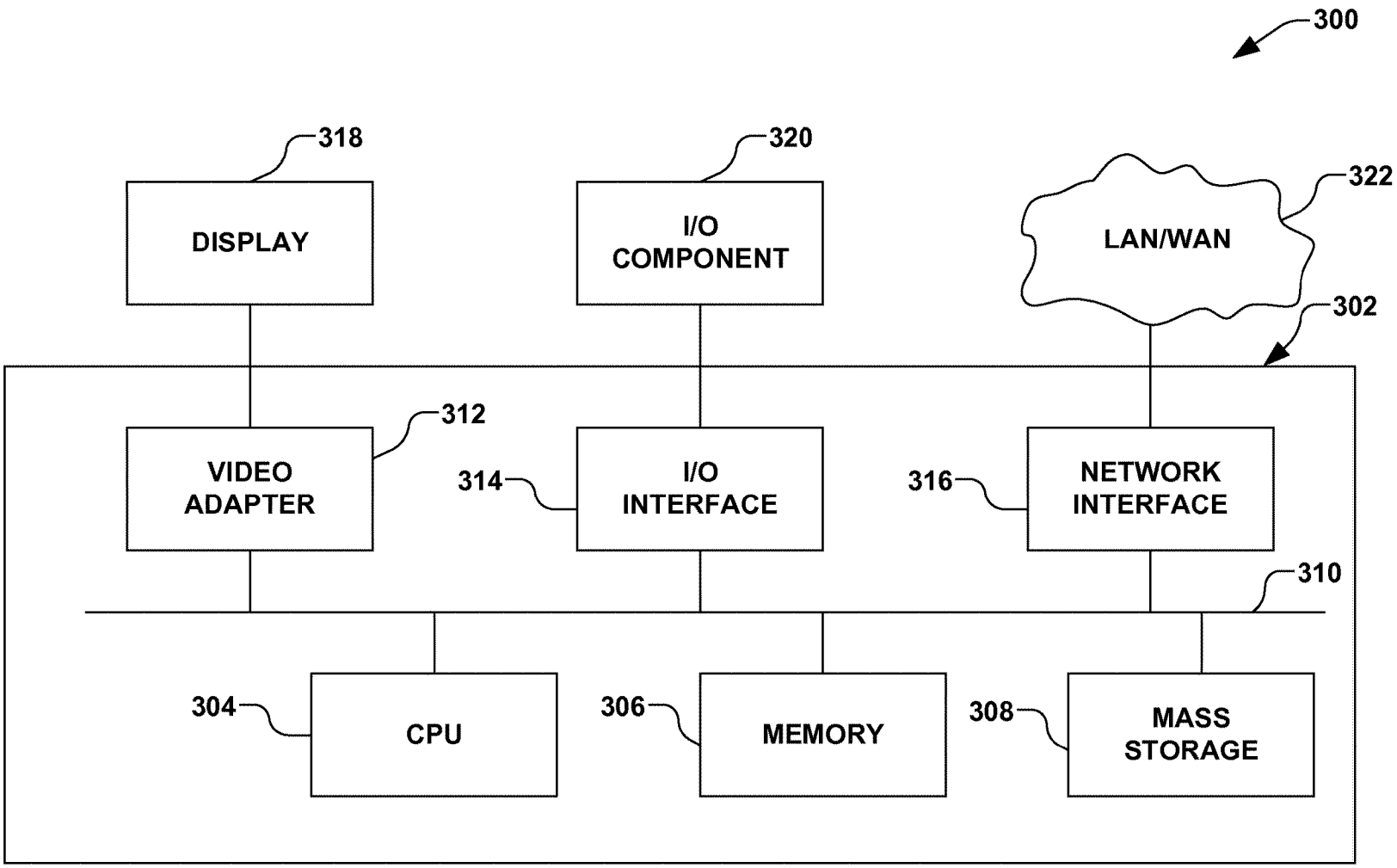
FIG. 5 illustrates a schematic representation of a processor-based system for chemical-mechanical polishing of a workpiece.

In accordance with another aspect, the aforementioned methodology may be implemented using computer program code in one or more general purpose computer or processor based system. As illustrated in FIG. 5, a block diagram is provided of a processor based system 300 is provided in accordance with another embodiment. The processor based system 300 is a general purpose computer platform and may be used to implement processes discussed herein. The processor based system 300 may include a processing unit 302, such as a desktop computer, a workstation, a laptop computer, or a dedicated unit customized for a particular application. The processor based system 300 may be equipped with a display 318 and one or more input/output devices 320, such as a mouse, a keyboard, or printer. The processing unit 302 may include a central processing unit (CPU) 304, memory 306, a mass storage device 308, a video adapter 312, and an I/O interface 314 connected to a bus 310.

The bus 310 may be one or more of any type of several bus architectures including a memory bus or memory controller, a peripheral bus, or video bus. The CPU 304 may include any type of electronic data processor, and the memory 306 may include any type of system memory, such as static random access memory (SRAM), dynamic random access memory (DRAM), or read-only memory (ROM).

The mass storage device 308 may include any type of storage device configured to store data, programs, and other information and to make the data, programs, and other information accessible via the bus 310. The mass storage device 308 may include, for example, one or more of a hard disk drive, a magnetic disk drive, or an optical disk drive.

The video adapter 312 and the I/O interface 314 provide interfaces to couple external input and output devices to the processing unit 302. Examples of input and output devices include the display 318 coupled to the video adapter 312 and the I/O device 320, such as a mouse, keyboard, printer, and the like, coupled to the I/O interface 314. Other devices may be coupled to the processing unit 302, and additional or fewer interface cards may be utilized. For example, a serial interface card (not shown) may be used to provide a serial interface for a printer. The processing unit 302 also may include a network interface 316 that may be a wired link to a local area network (LAN) or a wide area network (WAN) 322 and/or a wireless link.

It should be noted that the processor based system 300 may include other components. For example, the processor based system 300 may include power supplies, cables, a motherboard, removable storage media, cases, and the like. These other components, although not shown, are considered part of the processor based system 300.

Embodiments of the present disclosure may be implemented on the processor based system 300, such as by program code executed by the CPU 304. Various methods according to the above-described embodiments may be implemented by program code. Accordingly, explicit discussion herein is omitted.

Further, it should be noted that the modules and devices in FIG. 1 may all be implemented on one or more processor based systems 300 of FIG. 5. Communication between the different modules and devices may vary depending upon how the modules are implemented. If the modules are implemented on one processor based system 300, data may be saved in memory 306 or mass storage 308 between the execution of program code for different steps by the CPU 304. The data may then be provided by the CPU 304 accessing the memory 306 or mass storage 308 via bus 310 during the execution of a respective step. If modules are implemented on different processor based systems 300 or if data is to be provided from another storage system, such as a separate database, data can be provided between the systems 300 through I/O interface 314 or network interface 316. Similarly, data provided by the devices or stages may be input into one or more processor based system 300 by the I/O interface 314 or network interface 316. A person having ordinary skill in the art will readily understand other variations and modifications in implementing systems and methods that are contemplated within the scope of varying embodiments.

Although the present embodiments and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

While the method(s) provided herein is illustrated and described below as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the description herein. Further, one or more of the acts depicted herein may be carried out in one or more separate acts and/or phases.

It will be appreciated that while reference is made throughout this document to exemplary structures in discussing aspects of methodologies described herein, that those methodologies are not to be limited by the corresponding structures presented. Rather, the methodologies (and structures) are to be considered independent of one another and able to stand alone and be practiced without regard to any of the particular aspects depicted in the FIGS.

Also, equivalent alterations and/or modifications may occur to those skilled in the art based upon a reading and/or understanding of the specification and annexed drawings. The disclosure herein includes all such modifications and alterations and is generally not intended to be limited thereby. In addition, while a particular feature or aspect may have been disclosed with respect to only one of several implementations, such feature or aspect may be combined with one or more other features and/or aspects of other implementations as may be desired. Furthermore, to the extent that the terms "includes", "having", "has", "with", and/or variants thereof are used herein, such terms are intended to be inclusive in meaning—like "comprising." Also, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

What is claimed is:

1. A chemical-mechanical polishing system comprising:

a first polishing apparatus comprising a first platen and a first CMP head, wherein the first CMP head is configured to perform a first chemical-mechanical polish on a workpiece when the workpiece is positioned on the first platen;

a second polishing apparatus comprising a second platen and a second CMP head, wherein the second CMP head is configured to perform a second chemical-mechanical polish on the workpiece when the workpiece is positioned on the second platen, wherein each of the first platen and second platen are configured to concurrently support a plurality of workpieces;

a rework polishing apparatus comprising a rework platen and a plurality of rework CMP heads, wherein the plurality of rework CMP heads are configured to perform an auxiliary chemical-mechanical polish on a respective one of the plurality of workpieces when the respective one of the plurality of workpieces is positioned on the rework platen, wherein each of the plurality of rework CMP heads is configured to perform one of a rework of the first chemical-mechanical polish and a rework of the second chemical-mechanical polish, respectively;

a measurement apparatus arranged spatially between the first CMP head and the second CMP head and configured to measure one or more parameters;

a transport apparatus configured to transport the plurality of workpieces between each of the first polishing apparatus, the second polishing apparatus, the rework polishing apparatus, and the measurement apparatus; and a controller configured to selectively transport the respective one of the plurality of workpieces to the rework polishing apparatus via the transport apparatus only when the one or more parameters measured by the measurement apparatus are unsatisfactory, and wherein the controller is further configured to select a first one of the plurality of rework CMP heads to perform the auxiliary chemical-mechanical polish based on the one or more parameters measured by the measurement apparatus;

wherein the transport apparatus comprises:

a first robot configured to move along a first track that linearly extends in a first direction from a first position serving a loading apparatus directly coupled to a plurality of front opening unified pods (FOUPs), to a second position serving the first polishing apparatus, to a third position serving the second polishing apparatus, and to a fourth position serving the rework polishing apparatus;

a second robot configured to move along a second track that is arranged in parallel with the first track and that has a shorter length than the first track in the first direction, the second track linearly extending from a fifth position serving the loading apparatus, to a sixth position serving a cleaning apparatus, and to a seventh position serving the rework polishing apparatus; and wherein the second track is completely separated from the first polishing apparatus and the second polishing apparatus by the first track, wherein the first track extends in the first direction past one end of the second track, and wherein the first track is separated from the second track by a non-zero distance along a second direction that is perpendicular to the first direction.

2. The chemical-mechanical polishing system of claim 1, wherein the chemical-mechanical polishing system comprises a plurality of polishing stations.

3. The chemical-mechanical polishing system of claim 1, wherein the first robot is configured to selectively transport two or more workpieces via a dual-arm handling apparatus.

4. The chemical-mechanical polishing system of claim 3, wherein the first robot is configured to translate along the first track between two or more of the first, second, and rework polishing apparatuses, and a load lock chamber.

5. The chemical-mechanical polishing system of claim 1, wherein one or more of the plurality of rework CMP heads are further configured to perform an auxiliary polish of a specific location on the workpiece.

6. The chemical-mechanical polishing system of claim 1, wherein the first track continuously and linearly extends from directly in front of the loading apparatus, to directly in front of the first polishing apparatus, and to directly in front of the second polishing apparatus.

7. The chemical-mechanical polishing system of claim 1, further comprising:

a measurement station spatially separated from the first polishing apparatus, the second polishing apparatus, and the rework polishing apparatus.

8. The chemical-mechanical polishing system of claim 7, wherein the second robot is configured to move along the second track to an eighth position in communication with the measurement station.

9. The chemical-mechanical polishing system of claim 1, wherein the loading apparatus and the rework polishing apparatus are on opposite ends of the second track.

10. A method for chemical-mechanical polishing of a plurality of workpieces, the method comprising:

positioning the plurality of workpieces on a first platen via a transport apparatus;

polishing a surface of each of the plurality of workpieces positioned on the first platen to a rough polish via a first CMP head;

positioning each of the plurality of workpieces on a second platen via the transport apparatus;

polishing the surface of the each of the plurality of workpieces positioned on the second platen to a fine polish via a second CMP head;

measuring one or more parameters associated with the surface of each of the plurality of workpieces;

providing a respective workpiece of the plurality of workpieces to a selected rework CMP head of a plurality of rework CMP heads on a rework platen, wherein the respective workpiece is provided to the selected rework CMP head based on the one or more parameters; and wherein the transport apparatus comprises:

a first robot configured to move along a first track that linearly extends in a first direction from a first position serving a loading apparatus directly coupled to a plurality of front opening unified pods (FOUPs), to a second position serving a first polishing apparatus comprising the first platen, to a third position serving a second polishing apparatus comprising the second platen, and to a fourth position serving a rework polishing apparatus comprising the rework platen;

a second robot configured to move along a second track that is arranged in parallel with the first track and that has a shorter length than the first track in the first direction, the second track linearly extending from a fifth position serving the loading apparatus, to a sixth position serving a cleaning apparatus, and to a seventh position serving the rework polishing apparatus; and wherein the second track is completely separated from the first polishing apparatus and the second polishing apparatus by the first track, wherein the first track extends in the first direction past one end of the second track, and wherein the first track is separated from the second track by a non-zero distance along a second direction that is perpendicular to the first direction.

11. The method of claim 10, further comprising:

transporting a first workpiece of the plurality of workpieces from the first CMP head to the selected rework CMP head while concurrently transporting a second workpiece to the first CMP head.

12. The method of claim 10, further comprising:

transporting a first workpiece of the plurality of workpieces to the selected rework CMP head while concurrently transporting a second workpiece to one of the first CMP head and the second CMP head via a dual-arm handling apparatus.

13. The method of claim 10, further comprising cleaning the plurality of workpieces prior to measuring the one or more parameters.

14. The method of claim 13, wherein the first platen is configured to perform a first CMP polish that removes a dielectric material from a first workpiece of the plurality of workpieces and the second platen is configured to perform a second chemical-mechanical polish that removes a metal from the first workpiece of the plurality of workpieces.

15. A chemical-mechanical polishing system comprising:

a first polishing apparatus comprising a first platen and a first CMP head, wherein the first CMP head is configured to perform a first chemical-mechanical polish on a workpiece when the workpiece is positioned on the first platen;

a second polishing apparatus comprising a second platen and a second CMP head, wherein the second CMP head is configured to perform a second chemical-mechanical polish on the workpiece when the workpiece is positioned on the second platen;

a rework polishing apparatus comprising a rework platen and a plurality of rework CMP heads, wherein the plurality of rework CMP heads are configured to perform an auxiliary chemical-mechanical polish on a respective one of a plurality of workpieces when the respective one of the plurality of workpieces is positioned on the rework platen;

a measurement apparatus configured to measure one or more parameters of the respective one of the plurality of workpieces;

a transport apparatus, comprising:

a first track that linearly extends in a first direction from a first position serving a loading apparatus directly coupled to a plurality of front opening unified pods (FOUPs), to a second position serving the first polishing apparatus, to a third position serving the second polishing apparatus, and to a fourth position serving the rework polishing apparatus; and a second track arranged in parallel to the first track and having a shorter length than the first track, wherein the second track extends past one end of the first track along the first direction and extends in the first direction from a fifth position serving the loading apparatus, to a sixth position serving the measurement apparatus, to a seventh position serving a cleaning apparatus, and to an eighth position serving the rework polishing apparatus, the first track separated from the second track by a non-zero distance along a second direction that is perpendicular to the first direction; and a controller configured to operate the transport apparatus to selectively transport the respective one of the plurality of workpieces to the rework polishing apparatus.

16. The chemical-mechanical polishing system of claim 15, wherein a first robot is configured to move along the first track and a second robot is configured to move along the second track.

17. The chemical-mechanical polishing system of claim 16, wherein the first robot is configured to selectively transport two or more workpieces via a dual-arm handling apparatus.

18. The chemical-mechanical polishing system of claim 15, wherein the measurement apparatus is spatially separated from the first polishing apparatus.

19. The chemical-mechanical polishing system of claim 15, wherein the measurement apparatus is spatially separated from the rework polishing apparatus.

20. The chemical-mechanical polishing system of claim 15, wherein the loading apparatus and the rework polishing apparatus are on opposite ends of the second track.

* * * * *